United States Patent [19]

Kjaer et al.

[11] 4,354,511

[45] Oct. 19, 1982

[54] DEVICE FOR SPREADING TOBACCO LEAVES

[75] Inventors: Ian Kjaer, Hadsund; Hans J. Møller, Harlev J; Steen H. Nielsen, Gistrup, all of Denmark

[73] Assignee: Skandinanisk Tobakskompagni A/S, Soborg, Denmark

[21] Appl. No.: 244,690

[22] Filed: Mar. 17, 1981

[30] Foreign Application Priority Data

Apr. 2, 1980 [DK] Denmark ..... 1470/80

[51] Int. Cl.[3] ..... A24B 3/00; A24B 3/18; A24B 5/14; A46B 7/06

[52] U.S. Cl. ..... 131/324; 15/201; 131/325; 131/36

[58] Field of Search ..... 15/201; 131/324, 325, 131/31, 326, 314, 315, 318, 36

[56] References Cited

U.S. PATENT DOCUMENTS 3,296,643 1/1967 Fortune ..... 15/201

3,748,681 7/1973 Morris ..... 15/201

4,005,719 2/1977 Kjaer ..... 131/326

*Primary Examiner*—V. Millin

*Assistant Examiner*—D. Burke

*Attorney, Agent, or Firm*—Stevens, Davis, Miller & Mosher

[57] ABSTRACT

In a device for spreading tobacco leaves which, subsequent to having been moistened, are smoothed by passage in their transverse direction between a base and a sweeping brush or an analogous smoothing tool, said tool may be "broken" from its normal or straight operating position into a position in which its ends are raised higher from the base than its center portion. The operator is thus left more space for his hands that seize the leading edge of the tobacco leaf to be pulled across the base, and the smoothing operation at the largest portion of the tobacco leaf can be started earlier than the smoothing operation closer to the point and stalk ends of the leaf.

3 Claims, 2 Drawing Figures

1
2
3
4
5
6
7
7
8
9
9
10
10
11

1
2
3
4
5
6
7
8
9
10
11

DEVICE FOR SPREADING TOBACCO LEAVES

FIELD OF THE INVENTION

This invention relates to a device for spreading tobacco leaves which, subsequent to having been moistened, are smoothed by being passed in their transverse direction between a base and a sweeping brush or an analoguous smoothing tool that is movable between an open and a closed position in relation to the base.

BACKGROUND OF THE INVENTION

Such a spreader or stretcher is inter alia known from U.S. Pat. No. 4,005,719 according to which the operator manually seizes one of the lateral edge portions of a tobacco leaf close to its stalk or butt and its point or tip ends and passes this lateral edge portion into the gap between the base and the smoothing tool while in its open positon. The smoothing tool is then at once lowered to its closed position to cause a spreading or smoothing of the tobacco leaf in its transverse direction during the continuing relative movement between the leaf and the smoothing tool. In the embodiment of the apparatus concerned illustrated on the drawings of the patent the smoothing tool is a vertically movable brush and the base is constituted by a similar although stationarily located brush. It appears, however, from said reference that smoothing tools other than proper brushes may be used, for instance comparatively soft scrapers, rotating brush or fibre rollers and nozzles for emission of compressed air having a component of motion in the direction towards the trailing lateral edge of the tobacco leaf.

When using this device the operator must be careful to obtain a perfect spreading of the leading half of the leaf because the smoothing tool can be lowered to its closed or sweeping position only when the tool is behind operator's hands.

AIM AND SUMMARY OF THE INVENTION

It is an aim of the present invention to provide such an improvement of the above mentioned spreading device that a perfect spreading of the tobacco leaves to their full extent demands less attention from the operator.

This is obtained according to the invention by the fact that the smoothing tool is deformable between its normal or straight operating position and a position in which the smoothing tool at its ends is raised higher from the base than its centre portion.

In its deformed position the smoothing tool may be brought into sweeping touch with the tobacco leaf, already before the tool as a whole is situated behind operator's hands, and pari passu with the relative movement between the tobacco leaf and the smoothing tool this latter can occupy its straight position so as to successively get into sweeping contact along its entire length with the tobacco leaf, thus causing an effective and full or complete spreading or smoothing of the leaf.

In a preferred embodiment of the spreading device according to the invention the smoothing tool is composed of two sections which at their adjacent ends are tiltable on axes that are substantially perpendicular to the longitudinal direction of the tool and parallel to the base. This provides for obtaining a simple and sturdy structure that is further most reliable as to function.

The said two sections may for instance be mounted in a stationary carrier so that their movements between the open and closed positions in relation to the base is solely effected by tilting the sections in their bearings, but according to the invention it is preferred that the device comprises a tool carrier that is movable downwards and upwards relative to the base as known from the above mentioned reference. In this case the movement of the smoothing tool from its deformed to its straight position may according to the invention be coordinated with the movement of the tool carrier from its upper to its lower position, an easy and simple insertion of the leading lateral edge of the tobacco leaf (at the largest part of the leaf) thus being combined with an effective spreading of the entire leaf.

DETAILED DESCRIPTION OF THE PREFERRED EMBODIMENT

Figure 1:
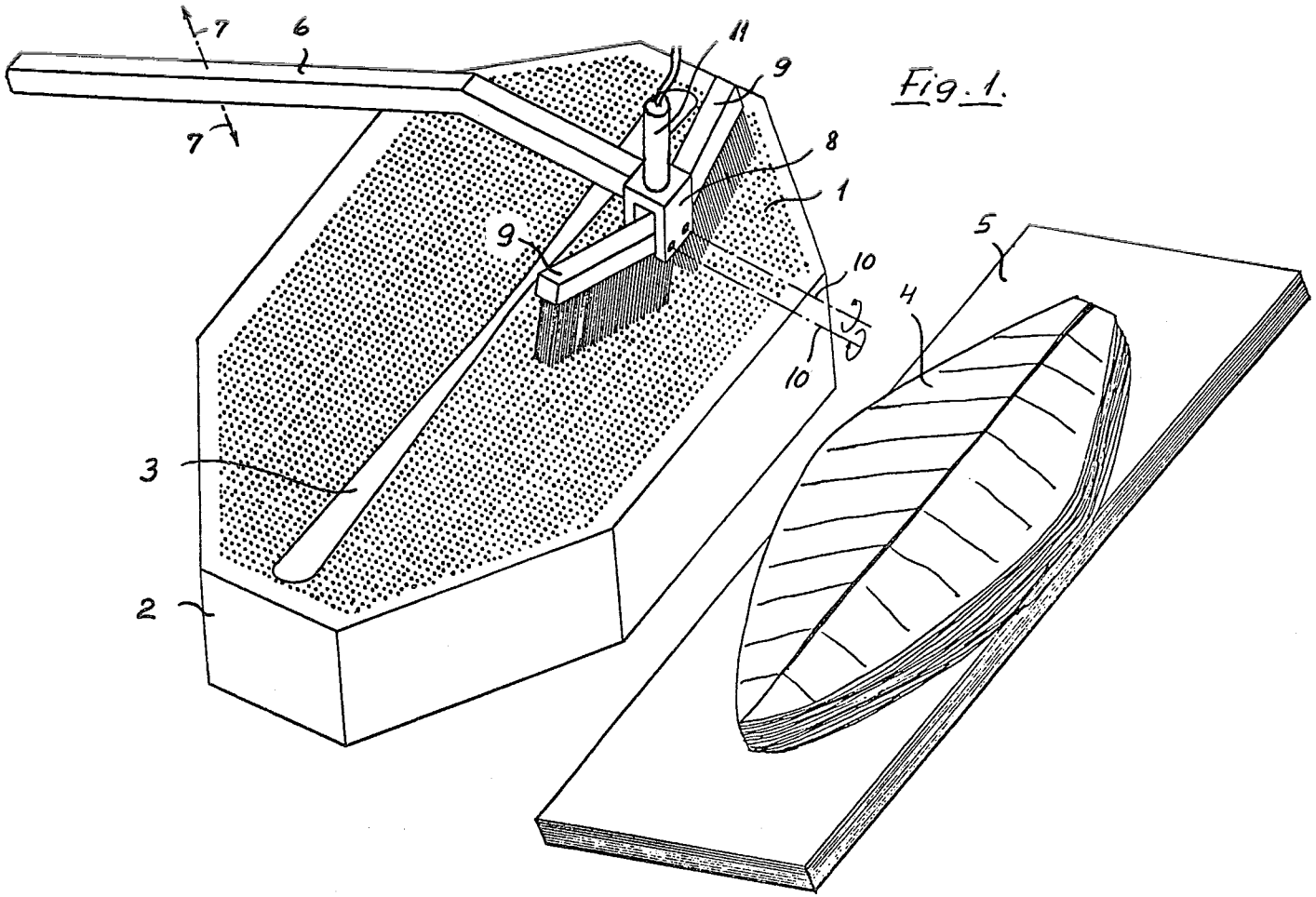
FIG. 1 illustrates the above mentioned embodiment of the spreading device comprising a smoothing tool composed of two brush sections, shown in the open or deformed position, and FIG. 2 the same device in its operating position.

The drawing shows a spread base 1 in the form of a perforated plate constituting the top plate of a suction box 2 and having a marker 3 to indicate the optimum placing of the mid rib of the tobacco leaves 4 to be spread or smoothed out. A stack of tobacco leaves is positioned on a table 5 in front of the suction box 2. A moderate vacuum can, when desired, be sustained in said box during the proper spreading operation and subsequently a more powerful vacuum can be used to fix the spread tobacco leaf during a subsequent cutting operation.

In a manner not shown in detail a lever 6 is mounted so that it can be swung in the vertical direction as indicated by the arrows 7. At its free end this lever 6 comprises a tool carrier 8 in the form of a fork in which two brush sections 9 are tiltable on their respective axis 10. The brush sections are thus tiltable between the deformed or angular position shown in FIG. 1 and the straight operating position shown in FIG. 2. The mechanism for effecting this movement of the brush sections 9 is symbolized in the drawings by a pneumatic cylinder 11 on the fork-shaped tool carrier 8.

Figure 2:
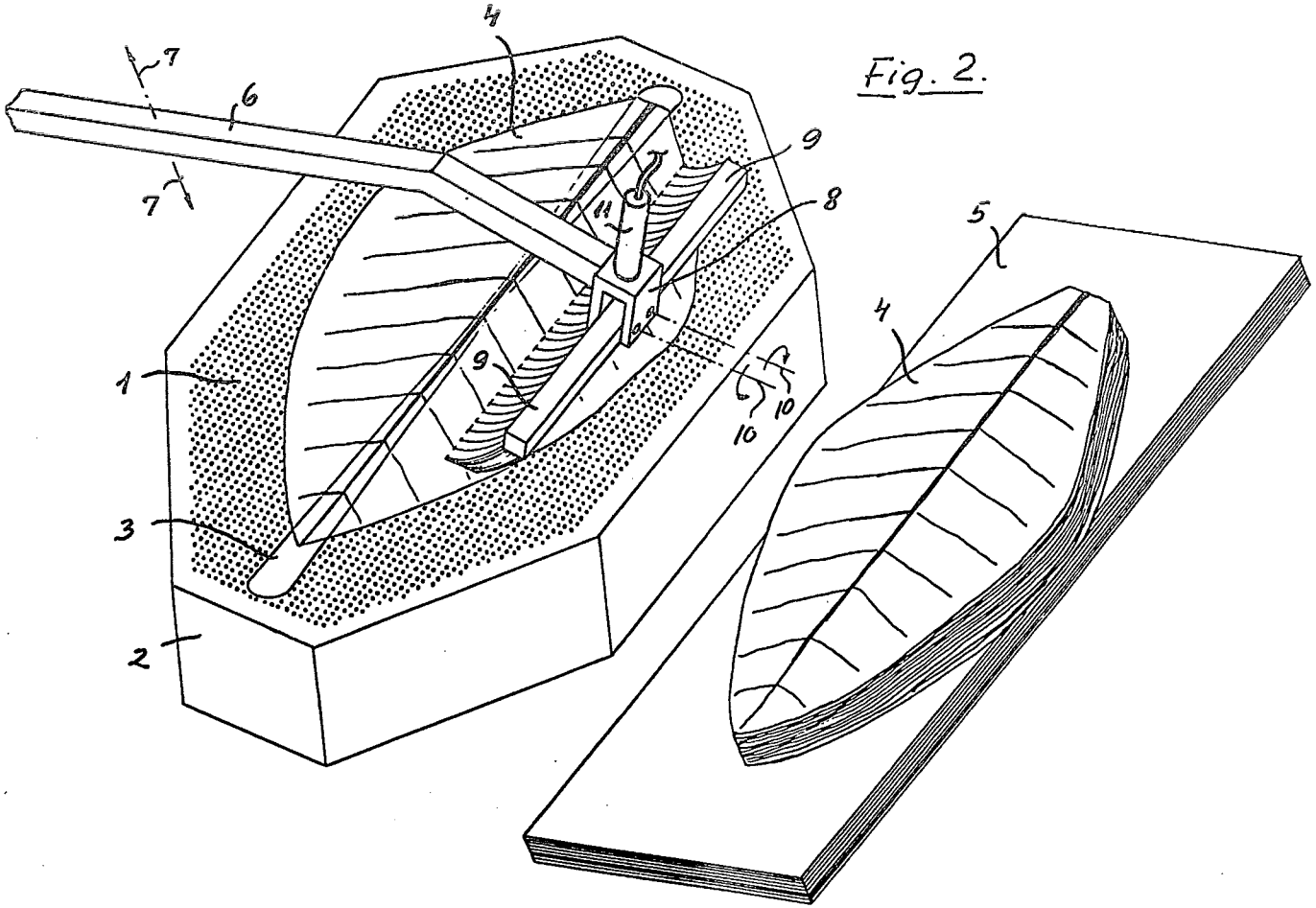

When the device is in the position shown in FIG. 1, the operator grasps the uppermost tobacco leaf 4 from the stack on the table 5 and draws it forwards across the spreader base 1. As soon as the central part of the leading lateral edge of the leaf has passed the middle of the smoothing tool 9, this latter is lowered towards the tobacco leaf, and while the leaf is pulled further forwards on the spreader base 1, the smoothing tool 9 is straightened into the position shown in FIG. 2, in which the tobacco leaf 4 has reached its final position on the perforated plate 1. The spreading of the tobacco leaf can then be completed by a relative movement between the smoothing tool 9 and the suction box 2. As mentioned above the smoothing tool needs not be a proper brush, as for instance air jets can act approximately in the same way as the bristles. It should further be mentioned that the smoothing tool can be composed of three sections, in that a centre section stationarily mounted in the tool carrier 8 may be inserted between the two sections 9 shown in the drawings. Another possibility is to make use of a flexible smoothing tool, for instance a brush which, from its normal or straight position can be deformed into a downwardly convex position.

We claim:

1. A device for spreading out tobacco leaves comprising means for receiving leaves, means defining a path of advance of leaves, a smoothing tool which is movable between an open and a closed position relative to said receiving means and movable relative to said path of advance, wherein said smoothing tool is deformable between a generally straight position in which it is substantially parallel to said receiving means, and a position in which its end portions have a greater distance from said receiving means than its centre portion.

2. A device as claimed in claim 1, wherein said deformable smoothing tool is composed of two sections which at their adjacent ends are tiltable on an axis that is substantially parallel to said path of advance.

3. A device as claimed in claim 1 comprising a tool carrier that is movable downwards and upwards relative to said path of advance, wherein the movement of the deformable smoothing tool from its deformed to its straight position is coordinated with the movement of the tool carrier from its upper to its lower position.

* * * * *